US006457183B1

(12) United States Patent
Perry, Sr.

(10) Patent No.: US 6,457,183 B1
(45) **Date of Patent: *Oct. 1, 2002**

(54) CAP

(76) Inventor: Bradford S. Perry, Sr., P.O. Box 611, Zachary, LA (US) 70791

( * ) Notice: Subject to any disclaimer, the term of this patent is extended or adjusted under 35 U.S.C. 154(b) by 0 days.

This patent is subject to a terminal disclaimer.

(21) Appl. No.: 09/707,331

(22) Filed: Nov. 7, 2000

Related U.S. Application Data

(63) Continuation-in-part of application No. 09/328,994, filed on Jun. 10, 1999, now Pat. No. 6,158,054.

(51) Int. Cl.[7] ..... A42B 1/00
(52) U.S. Cl. ..... 2/209.12; 2/195.1
(58) Field of Search ..... 2/195.1, 209.12, 2/15, 10, 425, 12, 171, 181.4, 181.6, 125.1

(56) References Cited

U.S. PATENT DOCUMENTS

| | | | | | |
|---|---|---|---|---|---|
| 1,782,206 | A | * | 11/1930 | Kornsweet | 2/195.1 |
| 5,224,772 | A | * | 7/1993 | Fustos | 362/105 |
| 5,509,145 | A | * | 4/1996 | Stevenson et al. | 2/195.1 |
| 5,893,173 | A | * | 4/1999 | Bray | 2/171 |
| 5,920,913 | A | * | 7/1999 | Brandon et al. | 2/209.12 |
| 5,987,648 | A | * | 11/1999 | Boyd | 2/195.1 |
| 6,158,054 | A | * | 12/2000 | Perry, Sr. | 2/195.1 |

* cited by examiner

*Primary Examiner*—Peter Nerbun
*Assistant Examiner*—Katherine Moran
(74) *Attorney, Agent, or Firm*—Jones, Walker, Waechter, Poitevent, Carrere & Denegre, L.L.P.

(57) ABSTRACT

A cap for permitting a wearer to use the cap as a device for catching falling objects, such as baseballs, therewith. The cap includes a cap with a bill outwardly extending therefrom. The bill has a plurality of spaced apart finger holes therethrough.

11 Claims, 3 Drawing Sheets

11
21d
21c
22
10
15
17
21a
21b
14

10
12
13
19
11
26
26
16
21a
23
18
21b
26
21c
21d
3
3
20
26

CAP

This application is a continuation-in-part of U.S. Ser. No. 09/328,994, filed Jun. 10, 1999, now U.S. Pat. No. 6,158,054

RELATED DATA

The subject matter of the present utility patent application has been registered with the United States Patent and Trademark Office under the disclosure document program. The request was received at the United States Patent and Trademark Office on Jan. 8, 1998 and was assigned the registration number 429906.

BACKGROUND OF THE INVENTION

1. Field of the Invention

The present invention relates to caps and other headwear and more particularly pertains to a new cap for permitting a wearer to use the cap as a device for catching falling objects, such as baseballs, therewith.

2. Description of the Prior Art

The use of caps and other headwear is known in the prior art. More specifically, caps and other headwear heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,509,145 by Stevenson et al; U.S. Pat. No. 4,873,726 by Tapia; U.S. Pat. No. 2,218,947 by Brunzell; U.S. Pat. No. Des. 281,031 by Gilligan; U.S. Pat. No. Des. 372,794 by Virzi; and U.S. Pat. No. Des. 369,232 by Ma. While these devices fulfill their respective, particular objectives and requirements, the aforementioned patents do not disclose a new cap. The inventive device includes a cap with a bill outwardly extending therefrom. The bill has a plurality of spaced apart finger holes therethrough.

In these respects, the cap according to the present invention substantially departs from the conventional concepts and designs of the prior art, and in so doing provides an apparatus primarily developed for the purpose of permitting a wearer to use the cap as a device for catching falling objects, such as baseballs, therewith.

SUMMARY OF THE INVENTION

In view of the foregoing disadvantages inherent in the known types of caps and other headwear now present in the prior art, the present invention provides a new cap construction wherein the same can be utilized for permitting a wearer to use the cap as a device for catching falling objects, such as baseballs, therewith.

The general purpose of the present invention, which will be described subsequently in greater detail, is to provide a new cap apparatus and method which has many of the advantages of the caps and other headwear mentioned heretofore and many novel features that result in a new cap which is not anticipated, rendered obvious, suggested, or even implied by any of the prior art caps and other headwear, either alone or in any combination thereof.

To attain this, the present invention generally comprises a cap with a bill outwardly extending therefrom. The bill has a plurality of spaced apart finger holes therethrough.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new cap apparatus and method which has many of the advantages of the caps and other headwear mentioned heretofore and many novel features that result in a new cap which is not anticipated, rendered obvious, suggested, or even implied by any of the prior art caps and other headwear, either alone or in any combination thereof.

It is another object of the present invention to provide a new cap which may be easily and efficiently manufactured and marketed.

It is a further object of the present invention to provide a new cap which is of a durable and reliable construction.

An even further object of the present invention is to provide a new cap which is susceptible of a low cost of manufacture with regard to both materials and labor, and which accordingly is then susceptible of low prices of sale to the consuming public, thereby making such cap economically available to the buying public.

Still yet another object of the present invention is to provide a new cap which provides in the apparatuses and methods of the prior art some of the advantages thereof, while simultaneously overcoming some of the disadvantages normally associated therewith.

Still another object of the present invention is to provide a new cap for permitting a wearer to use the cap as a device for catching falling objects, such as baseballs, therewith.

Yet another object of the present invention is to provide a new cap which includes a cap with a bill outwardly extending therefrom. The bill has a plurality of spaced apart finger holes therethrough.

Still yet another object of the present invention is to provide a new cap that lets a wearer sitting in the bleachers at a baseball game a means for catching a baseball hit into the bleachers without risk of injury to their hands from the impact of catching the baseball.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
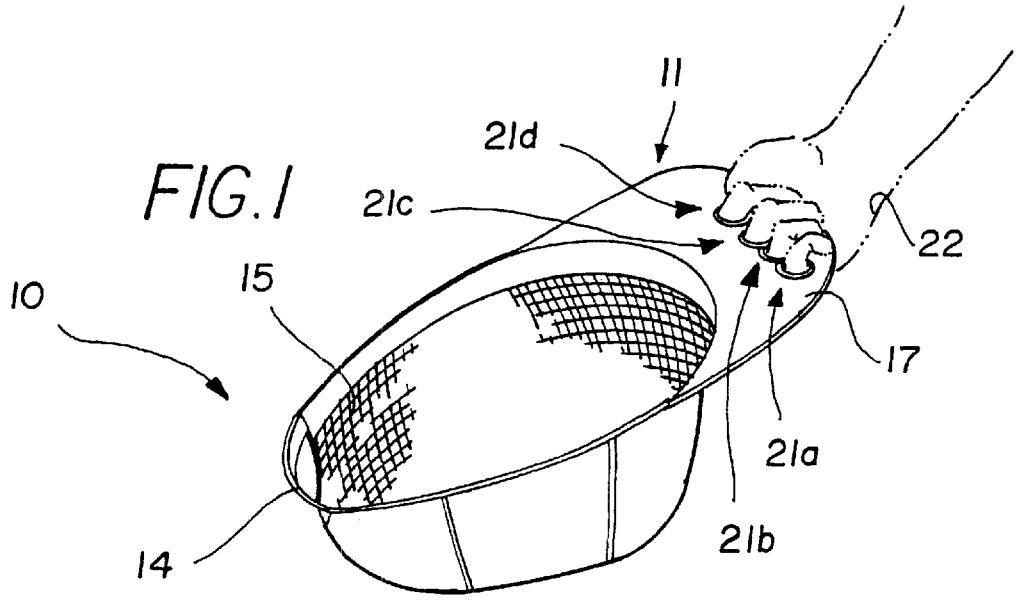
FIG. 1 is a schematic perspective view of a new cap in use as a device for catching a baseball according to the present invention.

With reference now to the drawings, and in particular to FIGS. 1 through 4 thereof, a new cap embodying the principles and concepts of the present invention and generally designated by the reference numeral 10 will be described.

As best illustrated in FIGS. 1 through 4, the cap generally comprises a cap with a bill outwardly extending therefrom. The bill has a plurality of spaced apart finger holes therethrough.

In closer detail, the cap 10 is designed for wear on the head of a user and has a bill 11 or visor outwardly extending therefrom. Like many traditional styles of caps, the cap may also include a plurality of eyelets 12 therethrough for providing ventilation, a button 13, a rear adjustment band 13, and optionally include mesh 14 in the interior of the cap.

The bill has upper and lower faces 16, 17, and an outer periphery comprising a front region 18 connecting a spaced apart pair of side regions 19, 20 together. The side regions are outwardly extended from the bill so that the front region is spaced apart from the cap.

The bill has a plurality of spaced apart finger holes 21*a*,21*b*,21*c*,21*d* therethrough extending between the upper and lower faces of the bill. In the ideal embodiment, the plurality of finger holes comprises four finger holes. Preferably, the finger holes are positioned closer towards the forwards region of the bill than towards the cap. In use, as illustrated in FIG. 1, the finger holes are designed for extending the fingers of a user's hand 22 therethrough so that the user may grasp the bill with the cap upside down ready to catch a baseball with the cap.

The finger holes are preferably arranged in an arcuate row extending between the side regions of the bill so that the concavity of the row faces towards the forwards region of the bill. The shape of the row is designed for more comfortably fitting the hand of a user grasping the bill with their fingers extending through the finger holes.

Figure 2:
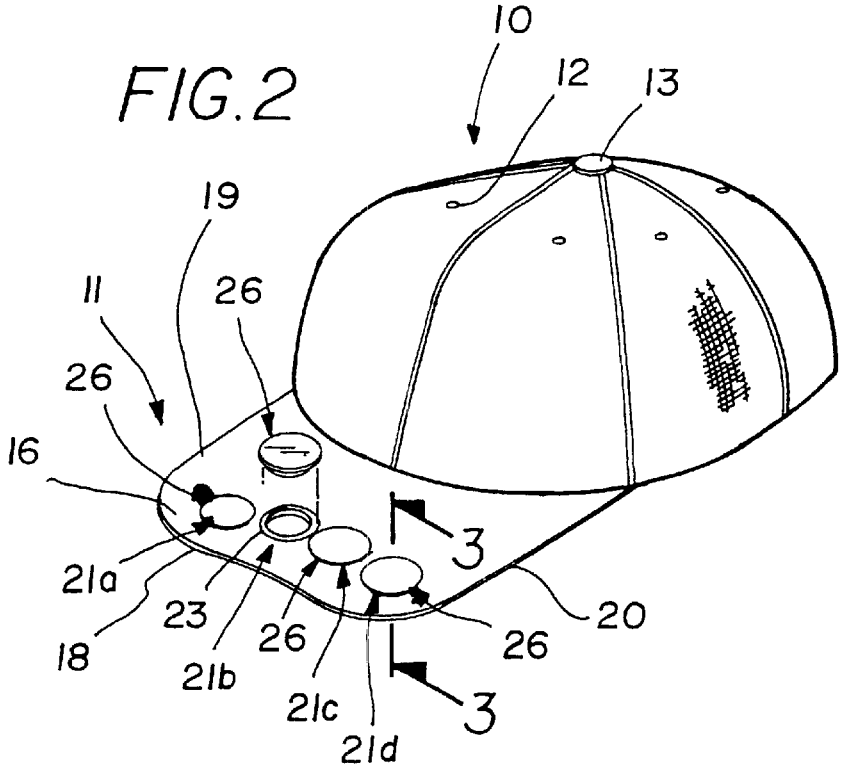
FIG. 2 is a schematic perspective view of the present invention with the stoppers being inserted into the finger holes when the cap is worn on the head of a user.
Figure 3:
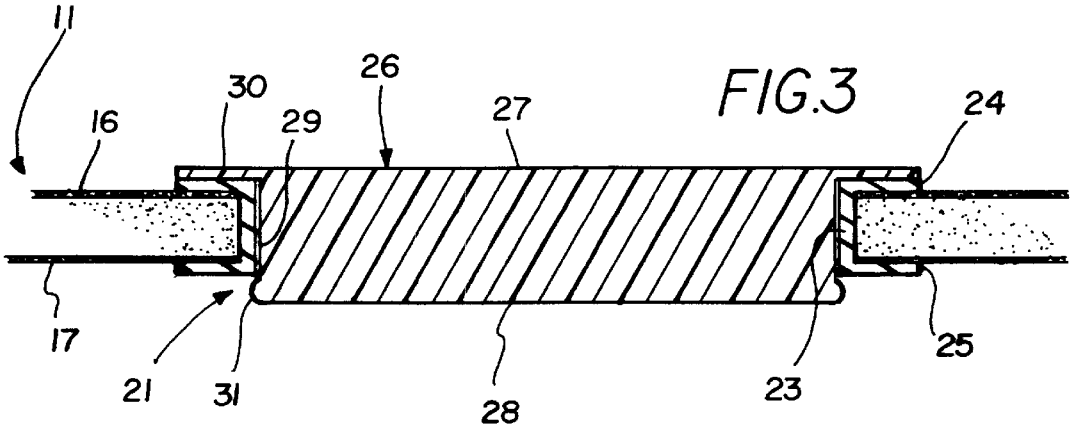
FIG. 3 is a schematic cross sectional view of a stopper in a finger hole taken from line 3—3 of FIG. 2.

Each of the finger holes of the bill preferably has a generally circular outer periphery. As best illustrated in FIGS. 2 and 3, each of the finger holes of the bill has an annular grommet 23 disposed therein and extending along the outer periphery of the respective finger hole. Each of the grommets preferably has spaced apart pair of annular flanges 24,25 extending radially outwards from the respective grommet. The flanges of each grommet are preferably substantially parallel to one another and substantially perpendicular to the respective grommet. As depicted in FIG. 3, the bill is positioned between the pair of flanges of each grommet to hold each grommet to the bill and in the associated finger hole. Ideally, each of the grommets comprises a resiliently deformable material such as a resiliently deformable rubber or plastic material so that the grommets and their flanges may be squeezed and deformed to fit inside their respective finger holes. This resiliently deformable material of the ideal embodiment also provides a more comfortable surface that is in contact with the skin on the user's fingers extending through the finger holes.

Figure 4:
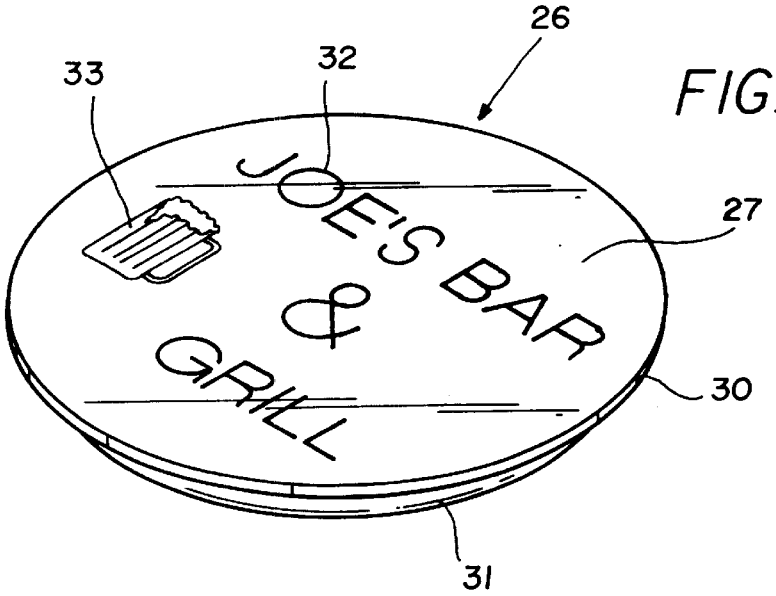
FIG. 4 is a schematic perspective view of a stopper.

In the preferred embodiment, the finger holes each have a generally disk-shaped stopper 26 removably inserted therein to close the respective finger hole. With reference to FIGS. 3 and 4, the stoppers each have generally circular and substantially planar top and bottom faces 27,28, and a generally cylindrical perimeter side 29 between the top and bottom faces of the respective stopper. As illustrated in FIGS. 2 and 3, the stoppers each are inserted into the respective finger hole such that the top face of each stopper is positioned adjacent the upper face of the bill and the bottom face of each stopper is positioned adjacent the lower face of the bill.

Ideally, the stoppers each comprise a resiliently deformable rubber or plastic material to permit flexing and bend of the stoppers to insert them into the finger holes. Each stopper also has a top flange 30 extending radially outwards therefrom adjacent the top face of the respective stopper. The top flange of each stopper preferably lies in a common plane with the top face of the respective stopper. Each stopper further has a bottom lip 31 extending radially outwards therefrom adjacent the bottom face of the respective stopper so that the bottom lip of each stopper is spaced apart from the top flange of the respective stopper. As illustrated in FIG. 3, the top flange of each stopper is positioned adjacent the upper face of the bill and the bottom lip of each stopper is positioned adjacent the lower face of the bill such that the bill is positioned between the top flange and bottom lip of each stopper. The top flange of each stopper is extended over the adjacent flange of the associated grommet in the associated finger hole. The bottom lip of each stopper is extended over the adjacent flange of the associated grommet in the associated finger hole. In an ideal embodiment, the outer diameter of each top flange of each stopper is about equal to the adjacent flange of the associated grommet.

Optionally, the top face of each stopper may have indicia 32 and designs 33 thereon such as logo's and slogans that may be used for advertising and team boosting purposes.

Figure 5A:
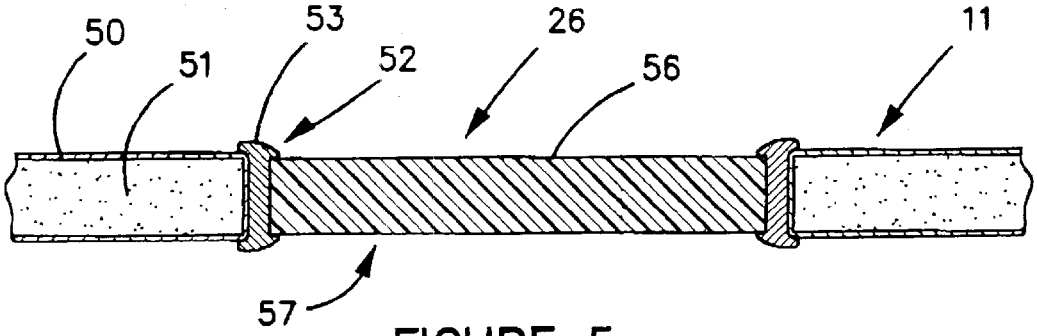
FIGS. 5*a*–5*c* are cross sections of the cap bill showing alternate embodiments of the finger hole and stopper arrangement.
Figure 5B:
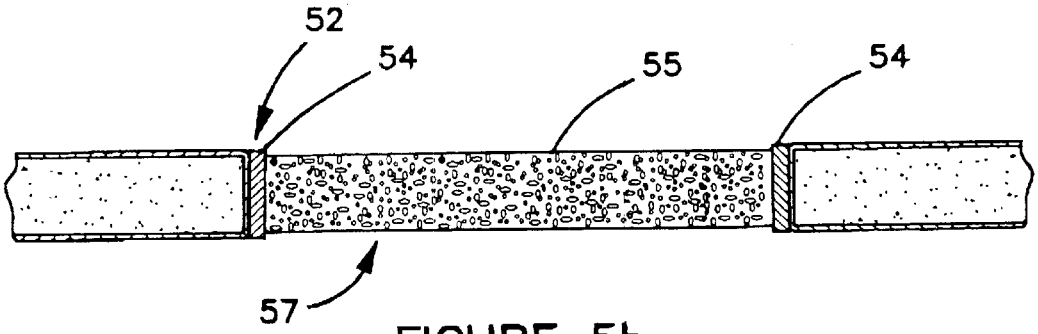
Figure 5C:
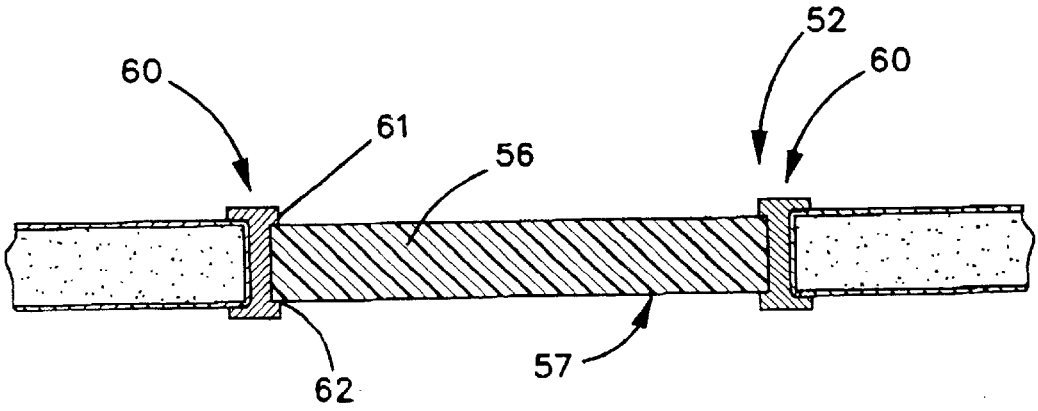

Other embodiments of the finger hole and stopper arrangement are seen in FIGS. 5a–5c. These figures show cross-sections of bill 11 similar to that seen in FIG. 3. FIG.

5*a* illustrates how bill 11 is formed of bill stiffener material 51 (such as polyethylene) and a overlaying clothe material 50 which is glued or sewn to stiffener material 51. When apertures 57 are made in bill 11 in order to form the above described finger holes, the perimeter of apertures 57 must be enclosed in a grommet or some type of sealing material in order to prevent the perimeter of apertures 57 from continually becoming more frayed and clothe material 50 separating from stiffener material 51. Therefore, the bill seen in FIGS. 5*a*–5*c* have a perimeter seal 52 formed around the circumference of aperture 57.

In FIG. 5*a,* perimeter seal 52 is formed of a resilient deforming sealing material 53. One example of material 53 could be an adhesive rubber-like substance such as a thermal plastic. In FIG. 5*a,* the stopper 26 is semi-rigid stopper 56. Stopper 56 may be able to flex somewhat, but it is sufficiently rigid that its diameter will not change when inserted into the aperture 57. Rather, material 53 deforms where in contact with the edge of stopper 56 and material 53 tends to rebound and overlap the upper and lower edges of stopper 56. It can be seen that sufficient material 53 will be applied to the perimeter of aperture 57 such that aperture 57 (with material 53 applied thereto) will be somewhat smaller than the diameter of stopper 56.

FIG. 5*b* shows an alternate embodiment. In FIG. 5*b,* perimeter seal 52 is formed of an adhesive rigid material 54 such as high-density foam and stopper 55 is formed of a resilient material such as foam rubber. In FIG. 5*b,* stopper 55 will typically have a diameter slightly larger than that of aperture 57. When stopper 55 is inserted into aperture 57, stopper 55 will compress to a small degree. The resilient nature of stopper 55 will cause it to attempt to expand, thereby assisting in holding stopper 55 against material 54 and securely within aperture 57.

FIG. 5*c* shows a still further embodiment. In FIG. 5*c,* perimeter seal 52 is formed of grommet 60. Grommet 60 is somewhat different from the grommet 23 seen in FIG. 3. Grommet 60 includes an upper lip 61 and a lower lip 62 that extend toward the center of aperture 57. The stopper 56 may be formed of the same material as disclosed above. Typically stopper 56 will be formed of a material which may flex somewhat while being inserted into grommet 60, but will return to its original diameter after being inserted. It can be seen how the upper lip 61 and lower lip 62 will securely hold stopper 56 in place. While it is preferred to insert a semi-rigid stopper 56 into grommet 60, it is also within the scope of the present invention to insert the resilient deforming stopper 55 into grommet 60.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An article of headwear comprising:

a. a cap adapted for wearing on the head of a user, said cap having a bill outwardly extending therefrom;

b. a plurality of apertures formed in said bill;

c. a perimeter seal formed around the perimeter of each of said apertures;

d. a stopper which is the approximate size and shape of said aperture, said stopper and said perimeter seal being adapted to retain said stopper when said stopper is inserted into said aperture.

2. An article of headwear according to claim 1, wherein said perimeter seal is formed of a resilient deforming sealing material and said stopper is formed of a material more rigid than said sealing material, such that said deforming sealing material overlaps an upper and lower edge of said stopper.

3. An article of headwear according to claim 1, wherein said perimeter seal is formed of a rigid sealing material and said stopper is formed of a resilient deforming material, such that said stopper deforms when inserted into said aperture and expands against said rigid perimeter seal in order to hold said stopper in place.

4. An article of headwear according to claim 1, wherein said perimeter seal is formed of a grommet having a upper and lower lip and said stopper is inserted between said upper and lower lip.

5. An article of headwear according to claim 4, wherein said stopper is formed of a material which expands back to its original shape and size after being inserted into said aperture.

6. An article of headwear according to claim 1, wherein said aperture is sufficiently large for fingers to be inserted therein.

7. An article of headwear according to claim 1, wherein said aperture and stopper are substantially round in shape.

8. An article of headwear according to claim 1, wherein said bill has a front region and a rear region, said apertures being formed closer to said front region than said rear region.

9. An article of headwear according to claim 8, wherein said bill has two side regions and said apertures are arranged in an arcuate row extending between said side regions.

10. An article of headwear according to claim 9, wherein said row has a concavity facing toward said front region of said bill.

11. An article of headwear according to claim 2, wherein a diameter of said aperture with said resilient deforming sealing material applied thereto is smaller than a diameter of said stopper.

* * * * *